US006393672B1

(12) United States Patent
Anscher

(10) Patent No.: US 6,393,672 B1
(45) Date of Patent: May 28, 2002

(54) D-RING ASSEMBLY

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 09/665,013

(22) Filed: Sep. 19, 2000

(51) Int. Cl.[7] ..... A44B 17/00; B60D 7/08; B61D 45/00

(52) U.S. Cl. ..... 24/265 R; 24/265 CD; 410/101

(58) Field of Search ..... 24/265 AL, 265 CD, 24/26 RR, 115 R, 115 K, 131 R; 410/101, 111, 112; 248/499; 224/616; 114/218, 253

(56) References Cited

U.S. PATENT DOCUMENTS 2,609,761 A * 9/1952 Clark ..... 24/265 CD X
2,702,513 A * 2/1955 Tuttle ..... 24/265 CD X
3,888,190 A * 6/1975 Bigge ..... 410/101
4,400,856 A * 8/1983 Tseng ..... 24/265 CD X
4,645,392 A * 2/1987 Takaguchi ..... 410/101 X
6,065,917 A * 5/2000 Shanbeau et al. ..... 410/112 X

* cited by examiner

*Primary Examiner*—Robert J. Sandy
(74) *Attorney, Agent, or Firm*—Collard & Roe, P.C.

(57) ABSTRACT

A D-Ring assembly comprises a base having a ring integrally formed therewith and protruding from the top surface of the base, and a grommet having an aperture therethrough. The grommet covers the base so that the ring protrudes through the aperture. In use, the base is mounted underneath the fabric or trim of a briefcase or other item, with the ring protruding through a hole in the fabric. The grommet is mounted on top of the base and fabric and secured to the base. The ring protrudes through the hole in the grommet and can be used to attach straps or other items to the assembly. This assembly is very secure because it does not depend on the strength of a narrow fabric or leather strap to stay mounted. It is also very sleek and attractive because it only protrudes a small amount from the surface of the bag or item to which the assembly is attached.

10 Claims, 2 Drawing Sheets

D-RING ASSEMBLY

BACKGROUND OF THE INVENTION

1. Field of the Invention

This invention relates to a D-Ring for attaching straps to luggage and other items. In particular, the invention relates to a D-ring that is secured to the bag or other item via a grommet that surrounds the base of the ring and keeps the ring securely fastened.

2. The Prior Art

Straps are often releasably secured to briefcases and luggage via D-rings that are sewn onto a loop on the bag. A hook on the strap is then snapped onto the D-ring to secure the strap to the bag. This arrangement is a convenient way to removably attach straps to items. However, the D-rings often fall off of the bag, due to stress on the sewn loop. In addition, the loop and D-ring can protrude excessively from the bag, creating an unattractive appearance, especially when the bag is used without its straps.

SUMMARY OF THE INVENTION

It is therefore an object of the invention to provide a D-ring that securely attaches to a bag or other item without the risk of removal or tearing of the bag.

It is another object of the invention to provide a D-ring that is unobtrusive and does not detract from the appearance of the bag or item to which it is attached.

It is yet another object of the invention to provide a D-ring that is simple and inexpensive to manufacture and install.

These and other objects of the invention are accomplished by a D-Ring assembly comprising a base having a ring integrally formed with and protruding from the top surface of the base, and a grommet having an aperture therethrough. The grommet covers the base so that the ring protrudes through the aperture. In use, the base is mounted underneath the fabric or trim of a briefcase or other item, with the ring protruding through a hole in the fabric. The grommet is mounted on top of the base and fabric and secured to the base. The ring protrudes through the hole in the grommet and can be used to attach straps or other items to the assembly. This assembly is very secure because it does not depend on the strength of a narrow fabric or leather strap to stay mounted. It is also very sleek and attractive because it only protrudes a small amount from the surface of the bag or item to which the assembly is attached.

The base and grommet can be attached to each other by any suitable means. One way is with screws that extend through holes in both the base and grommet. This would secure the base to the fabric of the bag as well as to the grommet. Another way is to mold studs on to either the base or the grommet and mold stud receptacles on the other part. The pieces can then be secured together by simply snapping the studs into the stud receptacles. Here, the studs also extend through the fabric of the bag to secure the entire assembly to the bag as well.

While the assembly according to the invention can be mounted on any part of the bag, it is often preferable to mount the assembly on a corner of the bag. This is especially true if the strap to be attached is a shoulder strap. For corner mounting, the base and grommet are curved so that the assembly can curve around the corner of the bag. Other shapes could also be envisioned, depending on the location of the assembly on the bag.

The assembly is preferably made of molded plastic.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
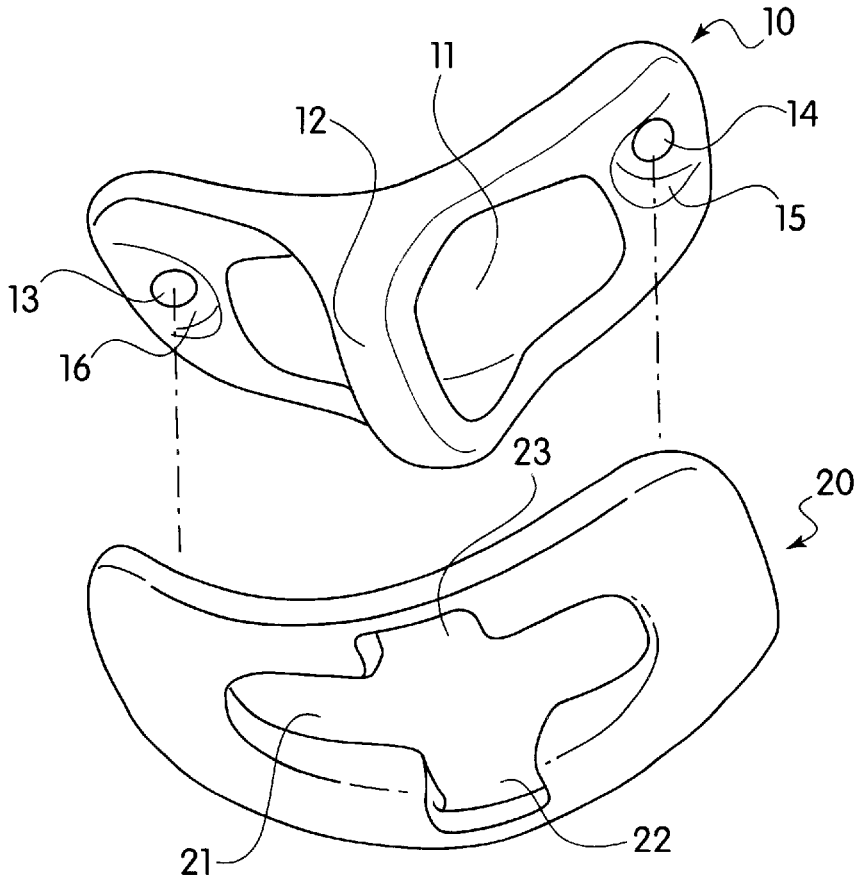
FIG. 1 shows a perspective view of the base and grommet of the assembly according to the invention.
Figure 2:
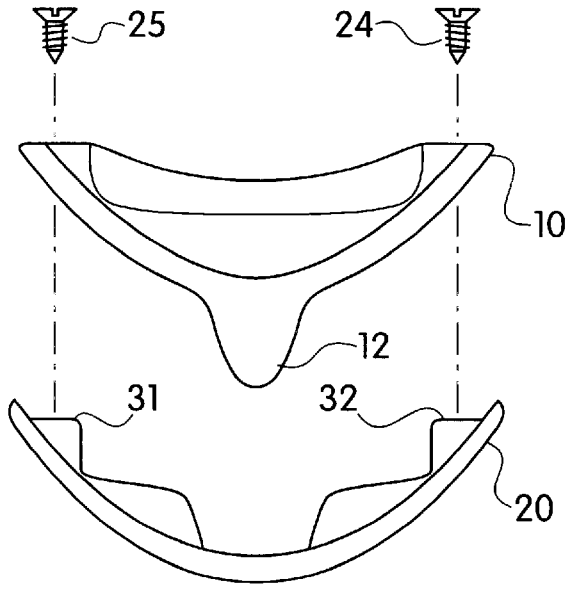
FIG. 2 shows an exploded side view of the base and grommet according to the invention.

Referring now in detail to the drawings and, in particular, FIGS. 1 and 2, there is shown the D-ring assembly comprising a base 10 and a grommet 20. Base 10 base a central aperture 11 and a protruding D-ring 12 molded integrally with base 10. There are screw holes 13 and 14 disposed within cavities 15 and 16 on base 10.

Grommet 20 has a central aperture 21, with side slits 22 and 23 to accommodate D-ring 12 when grommet 20 is mounted over base 10. Slits 22 and 23 keep base 10 from moving laterally after grommet 20 is mounted on top.

Figure 3:
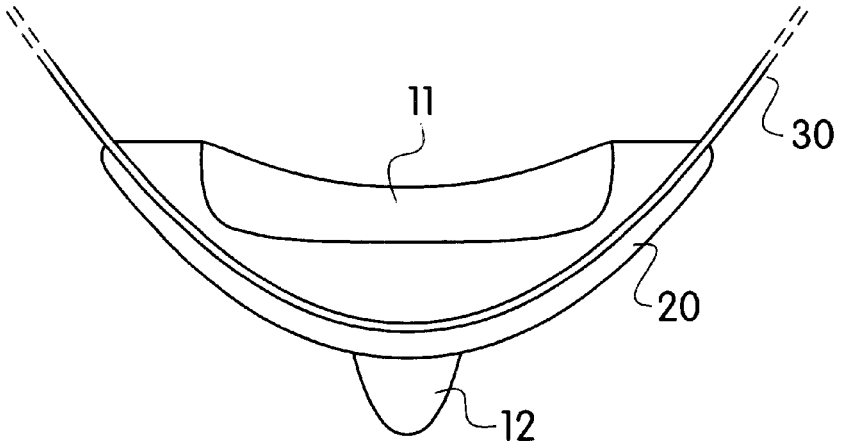
FIG. 3 shows a side cross-sectional view of the assembly as mounted on the corner of a bag.

To mount the assembly on an item such as a briefcase, base 10 is inserted beneath the outer fabric layer of the briefcase 30, and is disposed adjacent the inside surface of briefcase 30, as shown in FIG. 3. D-ring 12 then protrudes through a hole in the fabric to be visible from the exterior of briefcase 30. Grommet 20 is then placed over base 10 and briefcase 30, adjacent the outside surface of briefcase 30 and base 10 and grommet 20 are secured together with screws 24 and 25, as shown in FIG. 2. Grommet 20 has protrusions 31 and 32, which fit within cavities 13 and 14 on base 10 to help align base 10 with grommet 20. Screws 24 and 25 are inserted from behind base 10 and extend up through protrusions 31 and 32 on grommet 20 to secure base 10 and grommet 20 together.

Figure 4:
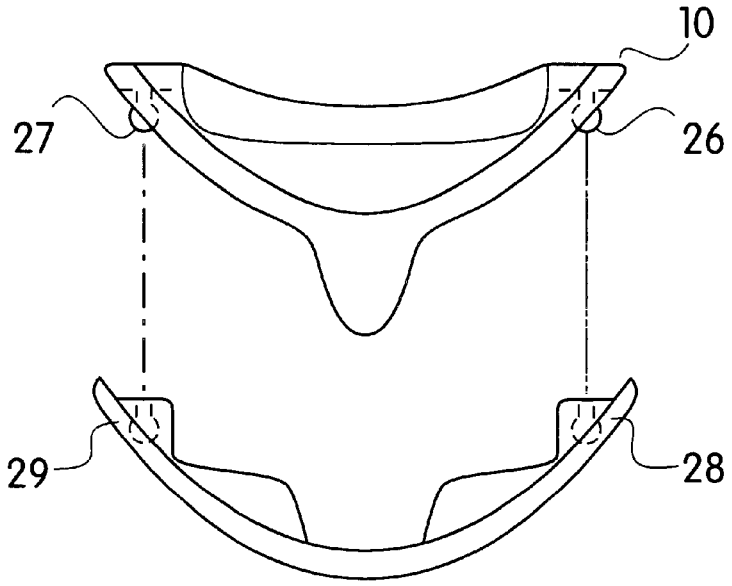
FIG. 4 shows an exploded side view of an alternative embodiment of the D-ring assembly according to the invention.

An alternative embodiment of the invention is shown in FIG. 4. Instead of screws to fasten base 10 and grommet 20 together, base 10 is comprised with two studs 26 and 27, which can be snapped into receptacles 28 and 29 on grommet 20. Alternatively, studs 26 and 27 could be located on grommet 20 with receptacles 28 and 29 on base 10. Any suitable fastening arrangement could be used to secure base 10 to grommet 20 and the invention is not limited to any particular fastening arrangement.

The embodiment shown in FIGS. 1–4 has a curved profile that is especially adapted for mounting on the corners of bags and briefcases. This location is preferred when mounting shoulder straps. However, the D-ring assembly according to the invention could be manufactured with a straight profile, for mounting on the face of an item. Other shapes could also be made, depending on the surface to which the assembly is mounted. The assembly is preferably made of a heavy duty plastic material, but any suitable material could be used.

Since the D-ring assembly according to the invention is secured to briefcase 30 through the fabric of briefcase 30, it is a very secure, low-profile arrangement. There is very little risk that base 10 will break through fabric 30 under stress, especially due to the large surface area of base 10. The assembly is very attractive and does not protrude unnecessarily from briefcase 30. D-ring 12 can be very low profile, because apertures 21 on grommet 20 and 11 on base 10 provide sufficient clearance for a snap hook or other type of fastener to be inserted underneath D-ring 12 to attach a strap to briefcase 30.

Accordingly, while only a few embodiments of the present invention have been shown and described, it is obvious that many changes and modifications may be made thereunto without departing from the spirit and scope of the invention.

What is claimed is:

1. A D-Ring assembly, comprising:

a base with a top surface and a bottom surface, and a ring integrally formed with and protruding from the top surface of the base, said base adapted to be placed underneath a layer of fabric with said ring protruding through a hole in the fabric; and a grommet having an aperture therethrough, said grommet adapted to cover said base and be placed on top of the fabric with said ring protruding through said aperture, so that the fabric is secured between the base and the grommet.

2. The assembly according to claim 1, further comprising screw holes in the base and grommet, wherein said base and grommet are secured together via screws through said screw holes.

3. The assembly according to claim 1, further comprising studs on one of the base and grommet, and stud receptacles on the other of the base and grommet, wherein said base is secured to the grommet portion by snapping the studs into the stud receptacles.

4. The assembly according to claim 1, wherein the base and grommet are curved for mounting the assembly on a curved surface.

5. The D-ring assembly according to claim 1, wherein the aperture in the grommet has two side slits, and wherein the ring is secured within the two side slits when the grommet is placed over the base, to prevent lateral movement of the base relative to the grommet.

6. An item with an integral D-ring assembly for attaching a strap thereto, comprising:

a bag having an inside surface and an outside surface; and a D-ring assembly attached to the bag and comprising:

(a) a base with a top surface and a bottom surface, and a ring integrally formed with and protruding from the top surface of the base, the top surface of said base disposed adjacent the inside surface of the bag with the D-ring protruding through a hole in the bag; and (b) a grommet having an aperture therethrough, said grommet being mounted to the base on the outside surface of the bag such that said ring protrudes through said aperture.

7. The item according to claim 6, wherein the base and grommet are secured together via screws.

8. The item according to claim 6, wherein one of the base and grommet contains studs and the other of the base and grommet contains stud receptacles, and wherein the base and grommet are secured together by snapping the studs into the stud receptacles.

9. The item according to claim 6, wherein the base and grommet are curved and are mounted on a corner of the bag.

10. The item according to claim 6, wherein the aperture in the grommet has two side slits, and wherein the ring is secured within the two side slits to prevent lateral movement of the base relative to the grommet.

* * * * *